United States Patent [19]

Anno et al.

[11] Patent Number: 4,681,068

[45] Date of Patent: Jul. 21, 1987

[54] BLOW-BY GAS PROCESSING ARRANGEMENT FOR AUTOMOTIVE INTERNAL COMBUSTION ENGINES

[75] Inventors: Nobuo Anno; Takeo Arai, both of Saitama, Japan

[73] Assignee: Honda Giken Kogyo Kabushiki Kaisha, Tokyo, Japan

[21] Appl. No.: 807,993

[22] Filed: Dec. 12, 1985

[30] Foreign Application Priority Data

Dec. 14, 1984 [JP] Japan ..... 59-263896

[51] Int. Cl.[4] ..... F02M 25/06

[52] U.S. Cl. ..... 123/41.86; 123/573

[58] Field of Search ..... 123/41.86, 572–574

[56] References Cited

U.S. PATENT DOCUMENTS 4,493,295 1/1985 Ampferer ..... 123/41.86

4,501,234 2/1985 Toki et al. ..... 123/41.86

4,502,424 3/1985 Katoch et al. ..... 123/41.86

*Primary Examiner*—William A. Cuchlinski, Jr.

*Attorney, Agent, or Firm*—Lyon & Lyon

[57] ABSTRACT

A blow-by gas processing arrangement for an internal combustion engine includes a cylinder block having a chamber for collecting a blow-by gas, a blow-by gas passage communicating with the chamber, and a plurality of spaced journal walls for supporting a crankshaft. A relatively large oil mist separating passage is defined in the cylinder block and extends into one of the journal walls, the oil mist separating passage communicating with the blow-by gas passage for preliminarily separating an oil mist from the blow-by gas supplied from the chamber. The blow-by gas processing device also includes an oil separator communicating with the oil mist separating passage for separating an oil mist from the blow-by gas supplied from the oil mist separating passage, a PCV valve connected to the oil separator, and an intake manifold connected to the PCV valve.

8 Claims, 6 Drawing Figures

BLOW-BY GAS PROCESSING ARRANGEMENT FOR AUTOMOTIVE INTERNAL COMBUSTION ENGINES

The present invention relates to a blow-by gas processing arrangement for use in an internal combustion engine for automobiles.

As automotive engines are designed for higher power outputs and higher rotational speeds in recent years, the amount of unburned air-fuel mixture leaking past the pistons from the combustion chambers, so-called "blow-by gas", has increased.

There are numerous blow-by gas processing arrangements in which the oil is separated from the blow-by gas produced in the engine and then the blow-by gas is introduced via a PCV (positive crankcase ventilation) valve into the intake manifold and burned again in the cylinders, see for example U.S. Pat. No. 4,502,424 assigned to the assignee of the present invention. In such prior art devices and arrangements, the oil mist is separated from the blow-by gas by an oil separator, and then delivered through the PCV valve into a portion of the intake system, such as the intake manifold. As the amount of the blow-by gas is increased, the amount of the oil mist included in the blow-by is also increased. The oil mist drawn into the engine with the blow-by gas tends to cause an incomplete combustion of the air-fuel mixture, resulting in an increase in undesirable pollutant emission. One solution would be to increase the capacity and hence the size of the oil separator. However, since the oil separator is disposed outside of the engine proper, the size of the overall engine system with such an enlarged oil separator would be unreasonably increased and would not be accommodated in a small engine compartment without substantial space limitations.

It is an object of the present invention to provide a blow-by gas processing arrangement for internal combustion engines which is of a simple structure having an oil mist separating passage defined in the cylinder block for preliminarily separating the oil mist from the blow-by gas so that the remaining oil mist can finally be removed effectively from the blow-by gas by an oil separator of a relatively small capacity and size.

Another object of the present invention is to provide a blow-by gas processing arrangement for internal combustion engines which allows a cylinder block to be cast without suffering casting defects such as cavities.

According to the present invention, a blow-by gas processing arrangement for an internal combustion engine includes a cylinder block having a chamber for collecting the blow-by gas, a blow-by gas passage communicating with the chamber, and a plurality of spaced journal walls for supporting a crankshaft. A relatively large oil mist separating passage is defined in the cylinder block and extends into one of the journal walls, the oil mist separating passage communicating with the blow-by gas passage for preliminarily separating an oil mist from the blow-by gas supplied from the chamber. The blow-by gas processing arrangement also includes an oil separator communicating with the oil mist separating passage for separating the oil mist from the blow-by gas supplied from the oil mist separating passage, a PCV valve connected to the oil separator, and an intake manifold connected to the PCV valve.

By the arrangement of this invention, the oil mist contained in the blow-by gas is preliminarily separated from the blow-by gas in the oil mist separating passage, and then separated by the oil separator. Therefore, the amount of the oil mist drawn into the intake manifold is minimized for completely combusting the air-fuel mixture in combustion chambers to improve the emission from the engine. The oil mist separating passage is relatively large in size so that the amount of molten metal required to cast the cylinder block, particularly the journal walls, is reduced to permit the molten metal to solidify at a uniform speed for eliminating casting defects such as cavities in the cylinder block.

The above and other objects, features and advantages of the present invention will become more apparent from the following description when taken in conjunction with the accompanying drawings in which a preferred embodiment of the present invention is shown by way of illustrative example.

FIG. 1 shows an in-line four-cylinder water-cooled internal combustion engine E having a cylinder block B with a cylinder head H mounted thereon and fastened thereto with a gasket G interposed between the cylinder block B and the cylinder head H.

Figure 1:
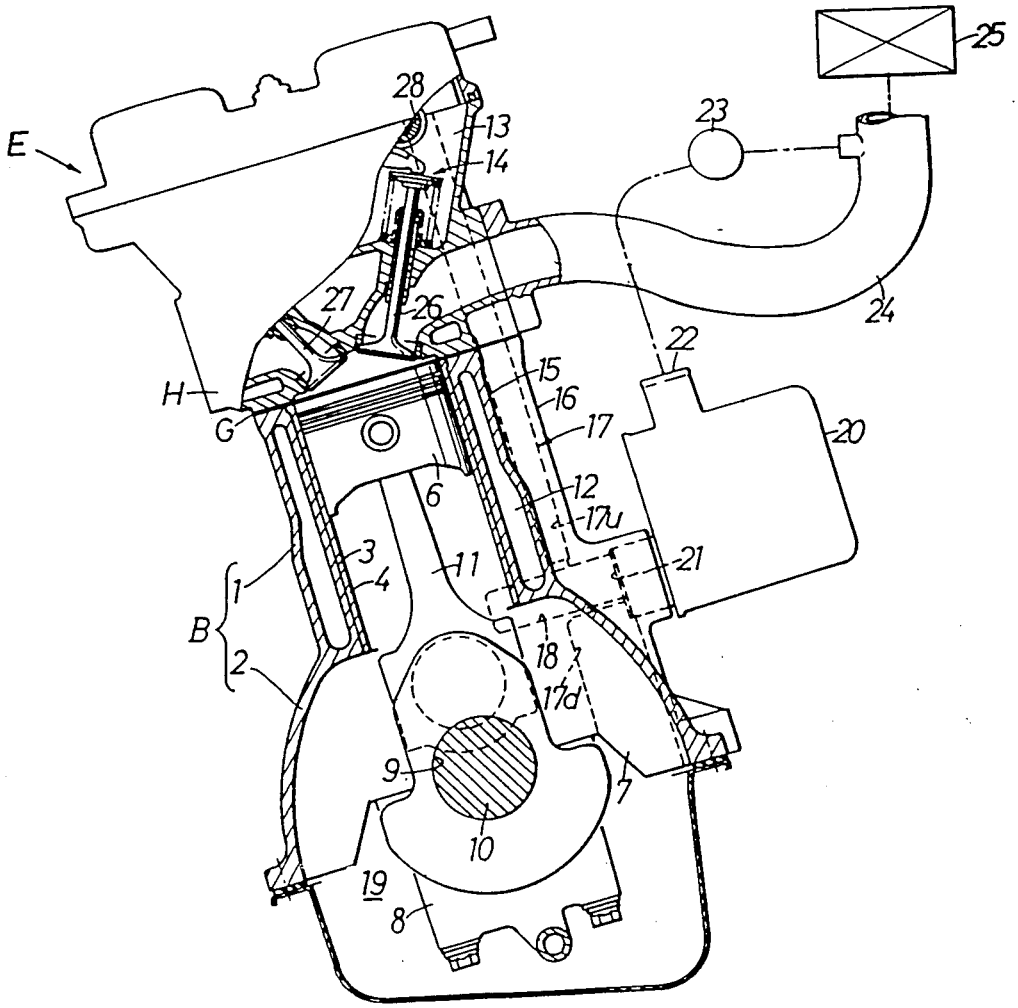
FIG. 1 is a vertical cross-sectional view of an internal combustion engine incorporating a blow-by gas processing arrangement according to the present invention.

The cylinder block B preferably is cast of an aluminum alloy such as by the casting process disclosed in U.S. Pat. Nos. 4,436,140 and 4,519,436. The cylinder block B generally comprises an upper cylinder-defining portion 1 and a lower crankcase-defining portion 2. The cylinder-defining portion 1 has four in-line cylinder bores 3 defined therein in the so-called Siamese configuration with no water jackets in the boundary walls 5 between the adjacent cylinder bores 3. A tubular cylinder liner 4 is fitted in each of the cylinder bores 3, and a piston 6 is slidably fitted in the tubular cylinder liner 4.

The lower crankcase-defining portion 2 of the cylinder block B has a plurality of integral journal walls 7 spaced at intervals along the direction in which the cylinder bores 3 are arranged in line. Bearing caps 8 are fixed to the lower surfaces of the journal walls 7, respectively. A crankshaft 10 is rotatably supported in bearing holes 9 defined between the journal walls 7 and the bearing caps 8. The crankshaft 10 is operatively connected to the pistons 6 by connecting rods 11.

The cylinder-defining portion 1 also has a water jacket 12 defined in surrounding relation to the cylinder bores 3. The water jacket 12 extends substantially the full length of each of the cylinder bores 3.

The cylinder head H has a valve cam chamber 13 accommodating therein a valve mechanism 14 including cam shafts 28 for operating intake and exhaust valves 26, 27.

Figure 2:
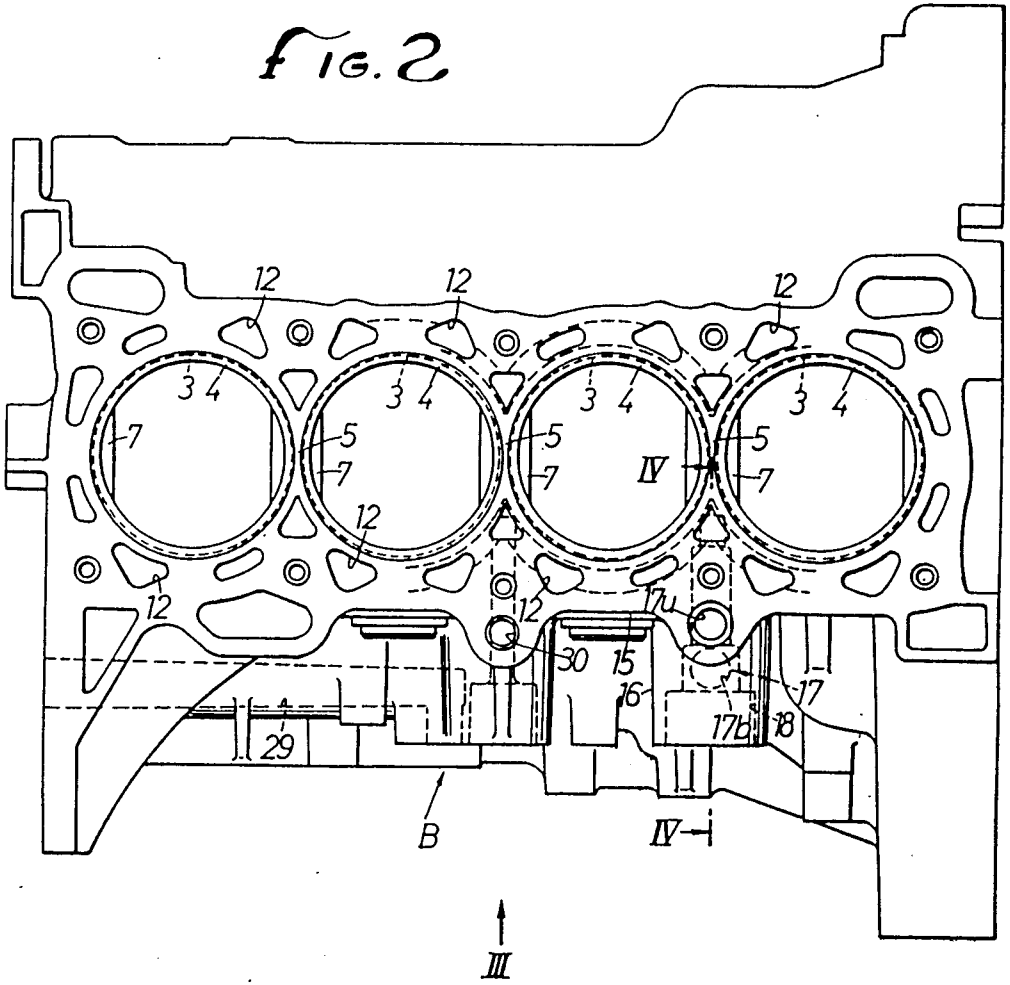
FIG. 2 is a plan view of the cylinder block of the engine shown in FIG. 1 with the cylinder head removed.
Figure 3:
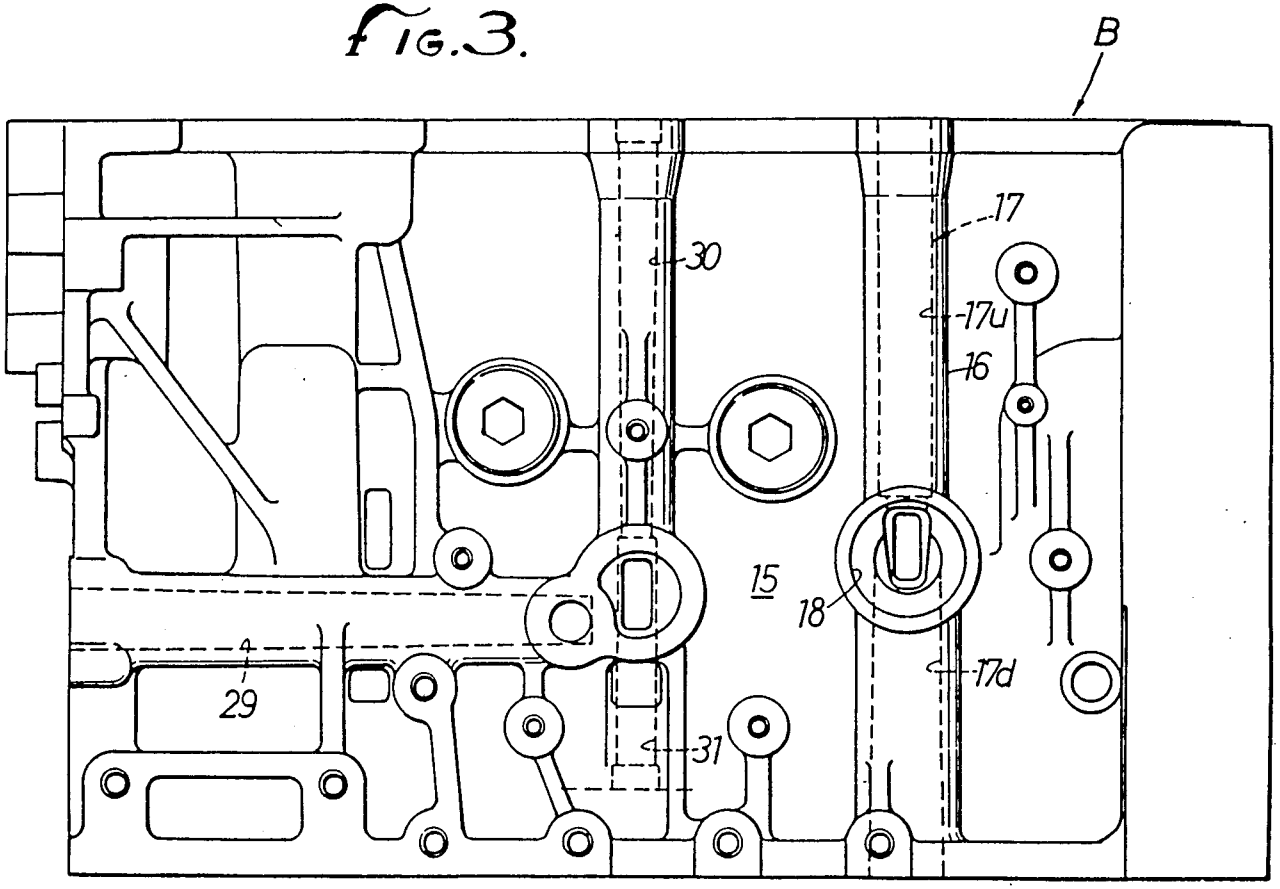
FIG. 3 is a side elevational view of the cylinder block as viewed in the direction of arrow III in FIG. 2.
Figure 4:
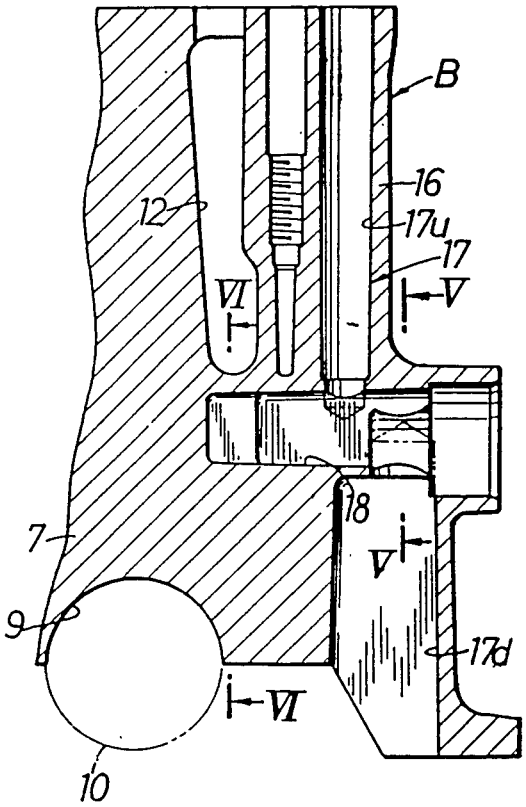
FIG. 4 is an enlarged fragmentary cross-sectional view taken substantially along line IV—IV of FIG. 2.

As illustrated in FIGS. 2 through 4, a bulging portion 16 is integrally cast with and projects laterally outwardly from the outer surface of one side wall 15 of the cylinder block B. The bulging portion 16 extends vertically for substantially the full height of the cylinder block B. A blow-by gas passage 17 is formed in the bulging portion 16 and includes an upper passage 17*u* and a lower passage 17*d* communicating with each other through an enlarged oil mist separating passage 18. The upper passage 17*u*, the lower passage 17*d*, and the enlarged passage 18 can be formed by using cores during the casting of the cylinder block B by the casting process referred to above. The enlarged passage 18 may be smoothly connected to both the upper passage 17*u* and and the lower passage 17*d* by drilling the cast boundary walls between the passages as shown by the phantom lines in FIGS. 4 and 5. As illustrated in FIG. 1, the upper passage 17*u* has an upper end opening into the valve cam chamber 13 in the cylinder head H, and the lower passage 17*d* has a lower end opening into the crank chamber 19 in the crankcase 2 of the cylinder block B.

Figure 5:
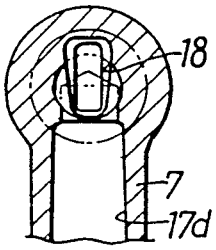
FIG. 5 is a fragmentary cross-sectional view taken substantially along line V—V of FIG. 4.
Figure 6:
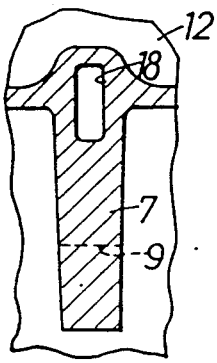
FIG. 6 is a fragmentary cross-sectional view taken substantially along line VI—VI of FIG. 4.

As shown in FIGS. 4 through 6, the enlarged passage 18 is of a substantially rectangular cross section and extends horizontally into one of the journal walls 7 in substantially perpendicular relation to the blow-by gas passage 17. The enlarged passage 18 has an outer end opening at the side wall 15 and an inner closed end. The water jacket 12 has its bottom located closely above the inner end of the enlarged passage 18 so that the enlarged passage 18 can be cooled by the cooling liquid in the water jacket 12.

As shown in FIG. 1, the open outer end of the enlarged passage 18 is connected to the inlet 21 of an oil separator 20 of a known structure which is located outside of the cylinder block B. The oil separator 20 has an outlet 22 coupled through a known PCV valve 23 to an intake manifold 24 which is connected between the air cleaner 25 and the intake valves 26.

Also as shown in FIG. 3, the cylinder block B may have oil galleries 29, 30 and 31 defined on the side wall 15 thereof for supplying lubricating oil to various engine parts such as the crankshaft 10 and the camshafts 28, which is not part of the present invention but rather is completely compatible herewith.

When the engine is operated, the suction or vacuum in the intake manifold 24 acts on the enlarged passage 18 through the PCV valve 23 and the oil separator 20. Therefore, the blow-by gas collected in the crank chamber 19 is forced to flow through the lower passage 17*d* into the oil mist separating passage 18, and the blow-by gas collected in the valve cam chamber 13 is forced to flow through the upper passage 17*u* into the oil mist separating passage 18. The oil mist contained in the blow-by gas is preliminarily separated from the blow-by gas in the oil mist separating passage 18. At this time, the oil mist can effectively be separated from the blow-by gas since the oil mist separating passage 18 is relatively large in volume and cooled by the cooling liquid in the water jacket 12. The blow-by gas is then delivered from the passage 18 into the oil separator 20 in which additional oil mist is separated from the blow-by gas. The blow-by gas is then drawn via the PCV valve 23 into the intake manifold 24 and finally burned in the combustion chambers.

When the cylinder block B is cast of an aluminum alloy by the casting process as referred to above, the molten aluminum alloy cools at a high speed and solidifies in a short period of time whereby it is preferable not to form thick walls and solid blocks which would require a large amount of molten metal when casting the cylinder block that may result in casting defects such as cavities. Since the enlarged passage 18 can be formed in the casting process by using a core extending into the journal wall 7 which would otherwise require a relatively large amount of molten metal to be poured and be liable to produce casting defects therein, the journal wall 7 can effectively be cast which is free from such casting defects because the presence of the enlarged passage 18 reduces the amount of molten metal required in casting the cylinder block B, particularly at that journal wall 7, and the molten metal can solidify at a uniform speed.

With the arrangement of this invention, the oil mist can preliminarily be separated from the blow-by gas while it is in the cylinder block B, and the oil separator 20 may be of a small capacity for reducing the oil mist still entrained in the blow-by gas before it is drawn into the combustion chambers. Therefore, the incomplete combustion of the air-fuel mixture can be minimized for higher engine performance and reduction of the pollutants in the exhaust gas. Inasmuch as the oil separator 20 may be of small size, the overall engine system may be smaller in size.

Although a certain preferred embodiment has been shown and described, it should be understood that many changes and modifications may be made therein without departing from the scope of the appended claims.

What is claimed:

1. A blow-by gas processing arrangement for an internal combustion engine, comprising:

a cylinder block having a chamber for collecting a blow-by gas, a blow-by gas passage communicating with said chamber, and a plurality of spaced journal walls for supporting a crankshaft;

a relatively large oil mist separating passage defined in said cylinder block and laterally extending into one of said journal walls beyond said blow-by gas passage, said oil mist separating passage communicating with said blow-by gas passage for preliminarily separating an oil mist from the blow-by gas supplied from said chamber;

an oil separator communicating with said oil mist separating passage for separating an oil mist from the blow-by gas supplied from said oil mist separating passage; and a PCV valve connected to said oil mist separator; and an intake manifold connected to said PCV valve.

2. A blow-by gas processing arrangement according to claim 1, wherein said oil mist separating passage extends substantially perpendicularly to said blow-by gas passage.

3. A blow-by gas processing arrangement according to claim 2, wherein said cylinder block has a water jacket defined therein, said oil mist separating passage has an inner closed end disposed below said water jacket.

4. A blow-by gas processing arrangement according to claim 1, wherein said oil mist separating passage has a substantially rectangular cross-section.

5. A blow-by gas processing arrangement in an internal combustion engine having an intake system and a cylinder block with a crankcase portion, comprising, a blowby gas passage formed in said cylinder block and extending upwardly from the crankcase, an oil mist separating passage formed in said cylinder block and extending laterally for intersecting said blow-by gas passage and beyond said blow-by gas passage to form a relatively large chamber, an oil separator connected to said oil mist separating passage and on the cylinder block, and means connecting said oil separator to the intake system for drawing blow-by gas from the crankcase through the blow-by gas passage then the oil mist separating passage and then the oil separator for minimizing the oil reaching the intake system.

6. The arrangement of claim 5 wherein the engine has a cylinder head mounted on the cylinder block, and said blow-by gas passage extends upwardly beyond said oil mist separating passage into the cylinder head.

7. The arrangement of claim 5 wherein the engine has a crankshaft supporting journal wall with said passages formed therein.

8. The arrangement of claim 5 wherein the cylinder block includes a water cooling jacket in close proximity with said oil mist separating passage for cooling same.

* * * * *